United States Patent [19]

O'Bryan

[11] Patent Number: 4,530,196

[45] Date of Patent: Jul. 23, 1985

[54] MODULAR BUILDING STRUCTURE

[76] Inventor: Frank L. O'Bryan, 12160 E. Amherst Cir., Aurora, Colo. 80012

[21] Appl. No.: 467,035

[22] Filed: Feb. 16, 1983

[51] Int. Cl.[3] ..... E04B 1/00

[52] U.S. Cl. ..... 52/747; 52/DIG. 9; 446/109; 446/478

[58] Field of Search ..... 52/741, 745, 748, 750, 52/631, 71, DIG. 9, 747; 229/32, DIG. 2, DIG. 4; 446/1 L, 109, 478

[56] References Cited

U.S. PATENT DOCUMENTS

| | | | |
|---|---|---|---|
| 2,072,698 | 3/1937 | Andrews | 46/21 |
| 2,169,318 | 8/1939 | Copeland | 229/DIG. 2 |
| 2,222,572 | 11/1940 | Reger | 229/DIG. 2 |
| 2,441,076 | 5/1948 | Markrianes | 446/109 |
| 3,199,763 | 8/1965 | Anderson | 229/DIG. 4 |
| 3,746,593 | 7/1973 | Majewski | 229/DIG. 4 |
| 3,905,540 | 9/1975 | Abert | 229/32 |
| 3,944,129 | 3/1976 | McCall et al. | 229/32 |
| 3,969,868 | 7/1976 | Bainter et al. | 52/631 |

OTHER PUBLICATIONS

Mechanix Illustrated, Box Yourself a Bungalow, 1 page, Feb. 1940.

*Primary Examiner*—John E. Murtagh
*Assistant Examiner*—Andrew Joseph Rudy
*Attorney, Agent, or Firm*—Klaas & Law

[57] ABSTRACT

Modular structural elements found by cutting, scoring and folding multiple layer corrugated paperboard sheets which can be used singly and in combination in the construction of a building structure.

9 Claims, 11 Drawing Figures

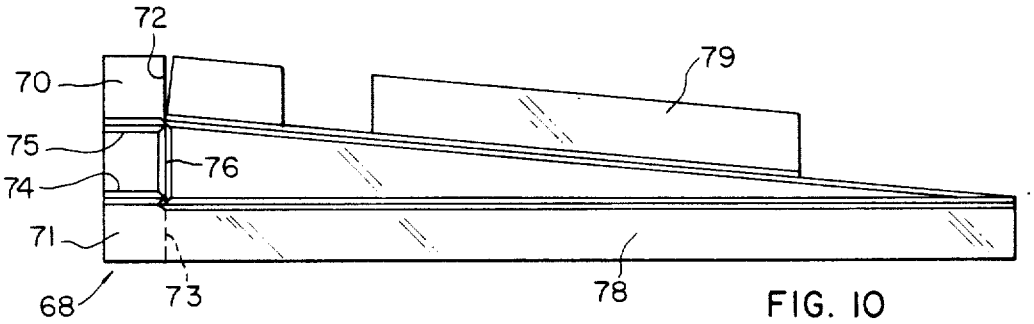
FIG. 10
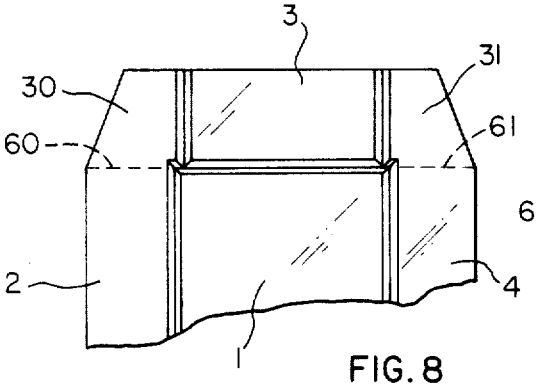
FIG. 8
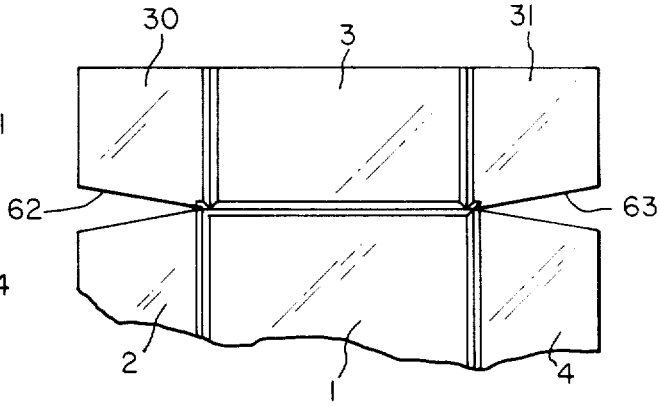
FIG. 7
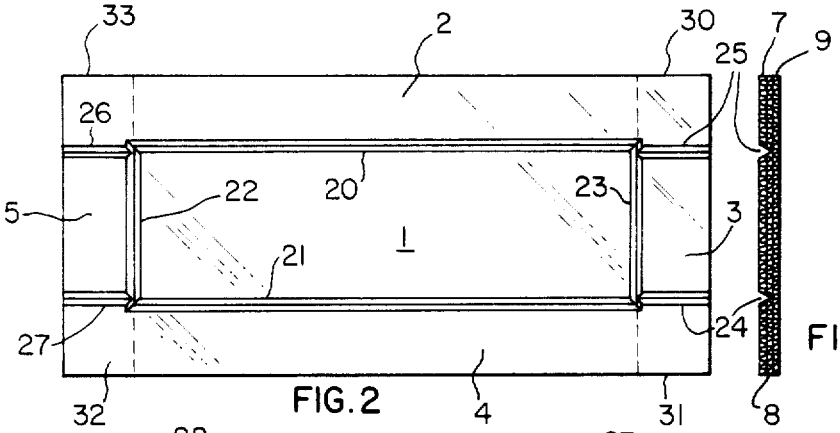
FIG. 2
FIG. 4
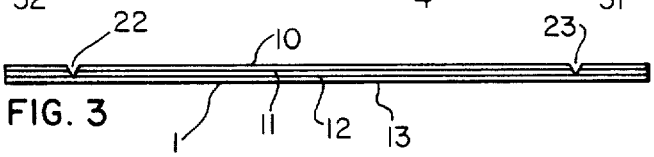
FIG. 3
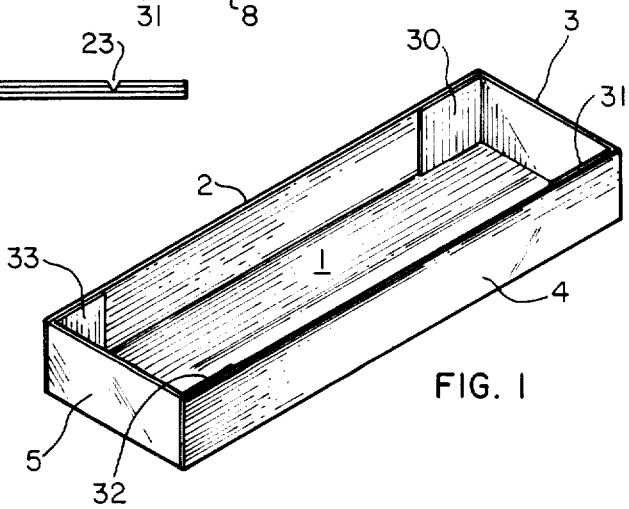
FIG. 1

MODULAR BUILDING STRUCTURE

BACKGROUND OF THE INVENTION

Field of the Invention

This invention relates to building structures and more particularly to novel structural elements for use in the construction of buildings.

It is desirable and important in the building construction trade that when new, strong, easy to handle construction materials are developed that their suitability for use in building structures is evaluated. This is particularly important where cost savings are achieved without sacrificing the necessary attributes which are currently provided by existing materials at higher prices. Further, on site construction time can be reduced dramatically where such new construction materials, and fabricated components made therefrom, can be prepared off site and then quickly assembled by conventional construction techniques when delivered to the building site.

It is therefore an object of the present invention to provide modular structural elements for building structures which utilize new materials which are preformed into panels and the like which can be assembled at the building site in a predetermined manner, utilizing conventional construction techniques.

It is another object of the present invention to provide a method of making such preformed modular structural elements which can be transported to a building site for use in constructing a building structure, and It is a further object of the present invention to provide building structures made from the novel modular structural elements of the present inventions.

SUMMARY OF THE INVENTION

The foregoing objects can be achieved according to the present invention by the cutting and shaping of a multi-layered corrugated fiberboard sheet structure in a manner to be able to produce modular structural elements which are suitable for use in the construction of buildings and the like.

BRIEF DESCRIPTION OF THE DRAWINGS

FIG. 1 is a perspective view of one modular structural element according to the present invention.

FIG. 2 is a plan view of a scored panel prior to its formation, by folding, into the modular structural element of FIG. 1.

FIG. 3 is a side elevation of the scored panel of FIG. 2.

FIG. 4 is an end elevation of the scored panel shown in FIG. 3.

FIG. 7 is a plan view of an alternative scored panel prior to its formation into a structural element according to this invention.

FIG. 8 is a plan view of another alternative scored panel prior to its formation into a structural element according to this invention.

FIG. 10 is a plan view of yet another alternative scored panel prior to its formation into a structural joist element according to this invention.

DETAILED DESCRIPTION OF THE INVENTION

Referring to FIGS. 1, 2, 3 and 4, a corrugated panel is shown with one configuration of end return flap when folded along the scores shown in the plan view (FIG. 2) and the side and end elevation views (FIGS. 3 and 4). For purposes of illustration only, the score lines shown are depicted as V-shaped grooves, which is functionally wide enough for a right angle fold to be made between the base 1 and the sides 2, 3, 4, and 5 of the structural element preferrably with the closing of the groove.

Figure 5:
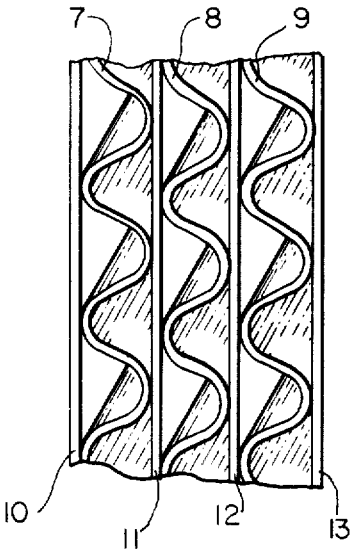
FIG. 5 is a fragmentary cross-sectional view of the preferred material used in the structural elements of the present invention.

The preferred corrugated material used in the present invention is shown in typical cross-section in FIG. 5.

The corrugated product shown in FIG. 5 is sold under the Trademark TRI-WALL PAK and is distributed by Tri-Wall containers of Woodbury, N.Y.

By way of example, the ⅝ths inch thick three layered corrugated is constructed with three fiberboard corrugated flutes (7, 8 and 9) with parallel longitudinal axes sandwiched between at least four layers of relatively heavyweight paper or fiber board (10, 11 12, and 13). Preferably, the paper or fiberboard utilized is sized for predetermined load bearing characteristics as well as optionally being treated with a fire retardent for fire resistance and a water repellant for water or moisture resistance. Other corrugated product containing laminates with other materials for specific characteristics may also be used to advantage in the practice of the present invention. In the preferred sheet material, the flutes and generally parallel facing sheets 10, 11, 12 and 13, can be used alone as shown in FIG. 5 and bonded in a conventional manner, as well as being augmented with layers or laminates of other materials or additional paper or fiberboard where particular moisture resistance characteristics, strength or decorative characteristics are sought. Many variations in the materials used are possible, the primary requirement being that the multiple layers of corrugated used should exhibit sufficient compressive strength for the applications, contemplated.

Figure 6:
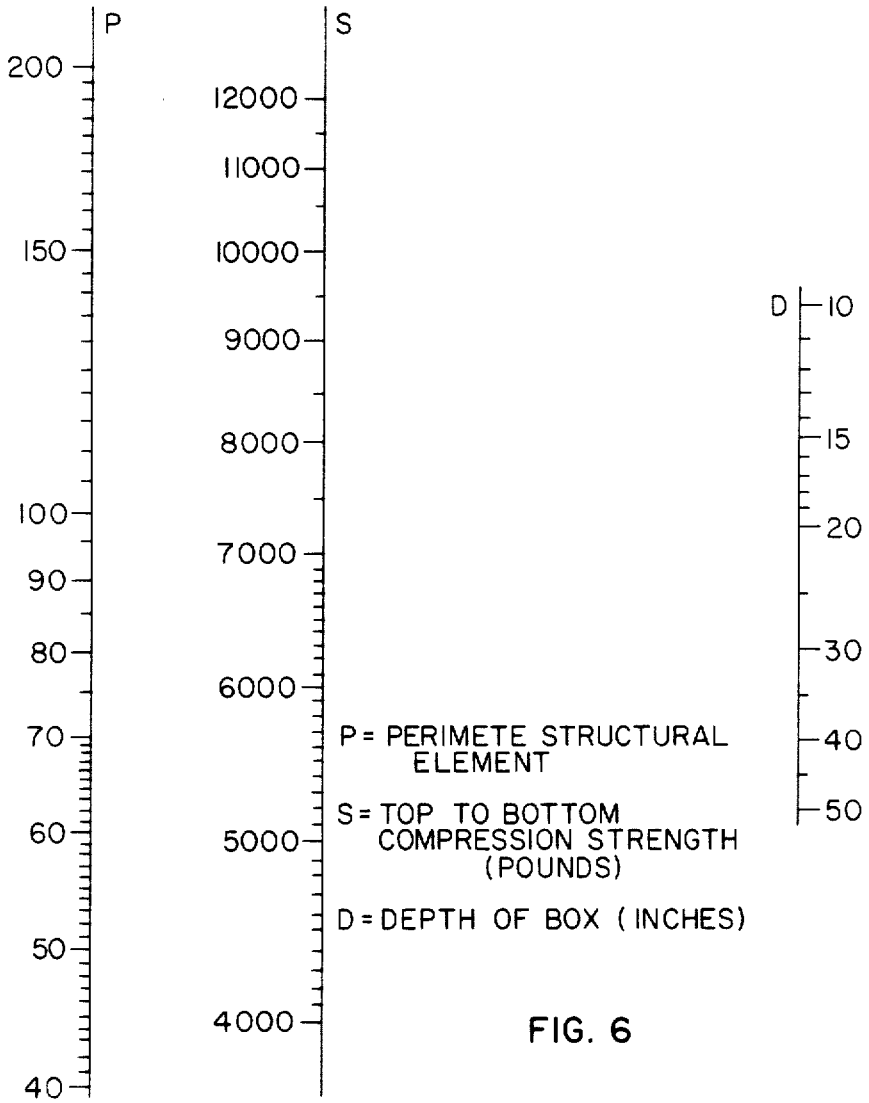
FIG. 6 is a chart for determining the compressive strength of RSC 1300 grade Tri-Wall Pak AAA.

FIG. 6 shows a typical calculating graph or chart that can be utilized to determine the compressive strength (under load applied parallel to the longitudinal axes of the flutes) of a structural element utilizing the ⅝ths inch Tri-Wall PAK AAA Grade RSC 1300 material of choice.

Referring again to FIGS. 1, 2, 3 and 4, the exact locations of the score lines 20, 21, 22, 23, 24, 25, 26 and 27 will be a matter of choice which will depend on the structural element being prepared and the design requirements of the finished structure. Where three layered ⅝ths inch Tri-Wall PAK AAA is utilized it is desireable that the top opening of the V-shaped scoring is approximately one inch across and the scoring extends downward through two layers of corrugating only. Likewise, it is desireable that the score lines 24, 25, 26 and 27 are parallel but laterally offset from the score lines 20 and 21 toward the interior of the element 1 so that the thickness of the flaps 30, 31, 32, and 33 can be accommodated inside the sidewalls 2 and 4 (FIG. 1) of the finished element 1.

The score cuts or lines can be cut, as by die cutting, by routed or even crushed with a V-shaped tool or prepared in any manner which will facilitate folding with the proper flap attachment, without loss of the strength sought in the finished element 1. Likewise, the flaps can be attached to the sidewalls 2 and 4 by adhesives, staples or the like to form the finished element 1 in a manner that retains the strength of the element for the use desired.

For purposes of illustration, in an element with a finished length of eight feet and a finished width of 16 inches, it has been found that a highly useful structural element can be fabricated having sidewalls 2 and 4 and end walls 3 and 5 of approximately seven inches with the flaps 30, 31, 32 and 33 returning approximately seven inches along the sidewalls 2 and 4. In this manner a satisfactory structural panel can be formed which can be joined together with similar panels to form wall structures, roof structures or the like. Attachment of the panels to each other can be made between the flaps on each of the structural elements to make unitary wall structures.

Figure 9:
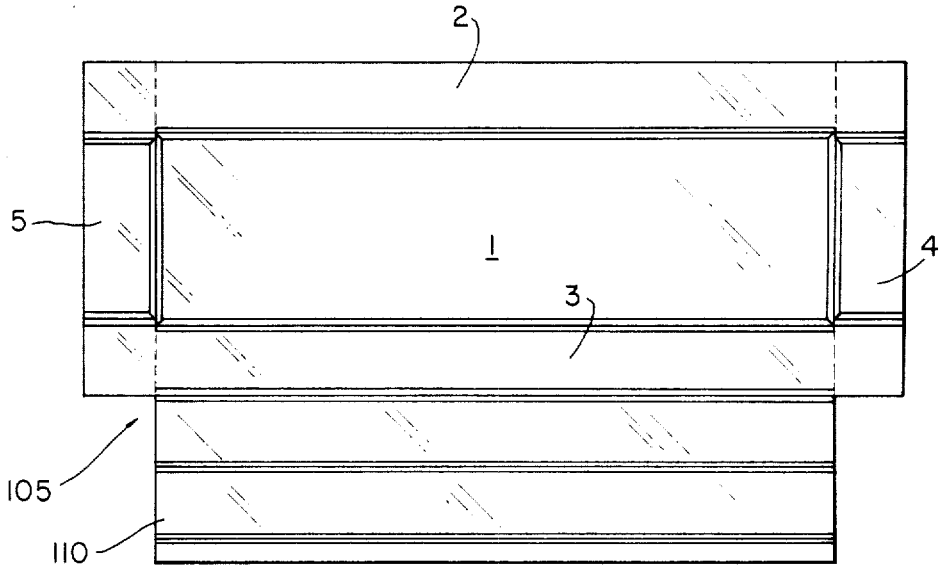
FIG. 9 is a plan view of yet another alternative scored panel prior to its formation into a structural beam element according to this invention.

Depending on the desired element or panel configuration sought, several modifications of the basic element structure shown are possible. For example, it is of course possible, if a beam-like structure, (as shown in FIG. 9), as opposed to a panel-like structure, is desired, then long, narrow structures having, for example, a regular polygon cross-section can be formed. As an example, it has been found that header elements with lengths between about 18 feet to 20 feet can be formed having widths of about one foot with between 6 to 7 inch side and end flaps, which successfully provide the requisite load bearing forces required of certain header structures when fabricated according to the invention as described herein.

Also, various end return modifications are possible. Such modifications can alter the specific applications of use by changing the strength of the modular panels or beams used in finished structures. For purposes of example, cuts may be made, as shown in FIGS. 7 and 8, at an angular relationship to the returns to establish a predetermined desired fit. Front and Rear or Top and Bottom end return flaps may vary and any combination of the following methods for creating end return flaps may be utilized on any panel or other modular structure such as a beam or roof joist, such as shown in FIG. 10.

FIGS. 1, 2, 3, and 4 shows the preferred method of scoring, slot cutting, folding, and securing the end return. Scoring is preferably done in parallel along the body of the panel. Other cuts are made parallel to the end cut to form the side return flap. The end return flaps are also scored parallel to the side cut at a point approximately ½" toward the center from the side scoring along the body when ⅝" Tri-Wall PAK AAA is employed. This indent allows or offset the end return flap to be folded along the scores and the slot cut end return portion to fold inside the side return flaps. The end return flap is then secured to the side flap with carpenter adhesive and/or staples in an approved array. Preferrably, the width and depth of the score are sized in a manner to permit the closure of the score when the flaps are folded into the finished position.

Alternate methods of scoring and cutting the end return flap can also be employed. For example, where it is desired to form a panel which may be attached to another panel, at the end, with the use of gussets or the like, the method of scoring along the body of the panel and parallel to the side cut can be identical to that used in the preferred panel, however, the end return flap is then made by scoring along the body of the panel and parallel to the end cut to a point approximately 1" toward the center from the side return score. Rectangular squares can then be cut from the corner end return flap. A second cut in the end return flap can be made from the point of beginning of the first cut at a 90 degree angle parallel to the end cut. In such an embodiment the return flaps can thereby be folded along the scores in such a manner that the end return flap does not meet the side return flap but instead there will be a gap along both sides of the end return flap to allow for the use of gussets to attach panels at a perpendicular or other angle to the end of the panel.

Likewise, the end return flap can be scored and cut to form an angled end panel, which may be used as a rear panel to establish a roof pitch or for other uses. The method of scoring along the body of the panel parallel to the side and end cuts is generally identical to that used in the preferred panel. A triangular section can then be cut from the side end return flaps in place of the simple straight cuts previously shown. The degree of the cut is determined by the desired angle of the end return flap with respect to the base of the sheet or element. Providing an angle in this manner allows the end return flaps to be folded along the scores and the angle cut end return portion to fold inside the side return flaps. The overlapping end return flap is then secured to the side return flap with carpenter adhesive and/or staples in an approved array to form an end flap which is at an angle other than 90 degrees to the base of the element. Referring specifically to FIGS. 7 and 8, it can be seen that the cuts 60, 61, 62 and 63 can be made at angle or a straight cut depending on the finished configuration desired.

Other useful construction elements may be made by varying the length, width, scoring and cutting of the basic element or panel to create beams, posts, soffits, facia, headers, etc., either attached to a panel (as shown in FIG. 9) or as a separate element.

Figure 11:
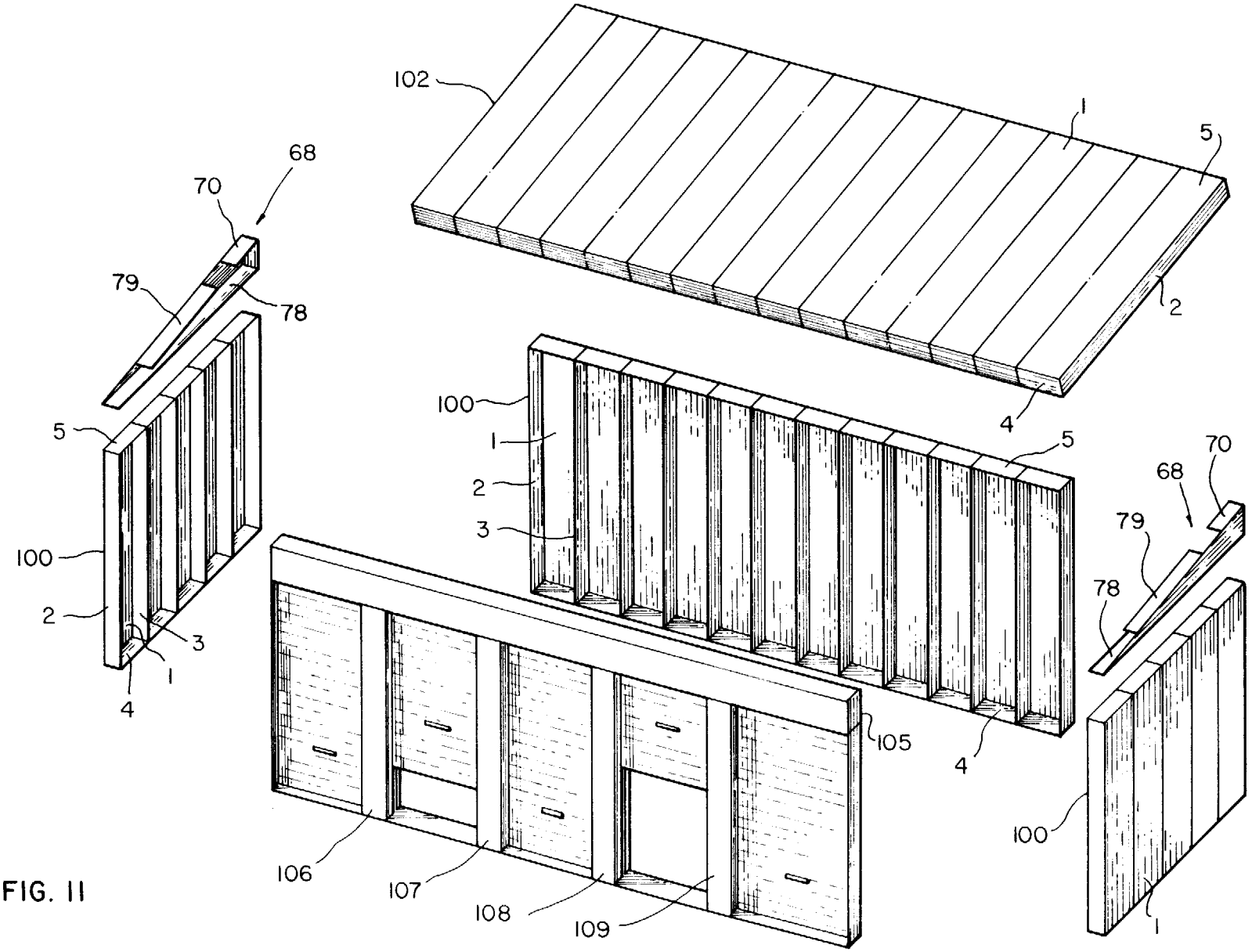
FIG. 11 is an exploded perspective view of a building constructed with the structural elements of the present invention.

FIG. 10 shows an example of the kind of scoring required to create a beam 68 attached to the top of a vertical wall panel 100 created from the preferred structural element and extending transversely to the vertical longitudinal axes of the flutes as shown in FIG. 11. The end return flaps 70 and 71 are folded about the cut lines 72 and 73 and scores 74, 75 and 76 to form a box-like end (as shown in FIG. 11) with the flaps 78 and 79 forming respectively the surfaces for attachment to the top of wall structures 100 and roof structures 102 (FIG. 11) respectively.

As shown, the method for the creation of a gable support could be used in creating fillers, angle blocks and supports of various sizes. The angle of the score is determined by the specifications for the structure. Shapes other than the triangular forms shown may be created in a similar fashion and are included in this invention.

As shown more fully in FIG. 11, building structures, such as shown there, can be constructed by utilizing combinations of structural elements in the manner shown. For example, vertical wall structures such as 100 can be formed by fastening together the box-like structures shown in FIG. 1. Likewise, roof structures 102 can be formed in a similar manner. Beam structures such as shown at 105 and posts 106, 107, 108 and 109 with a back flap panel 110 can be employed alone or in combination with panels, as shown in FIGS. 9 and 11 to form a wall structure containing doors or the like, and the entire structure when assembled can be affixed to a foundation in a conventional manner. Likewise, exterior siding, roofing materials and the like can be utilized in a conventional manner if desired. The result from the use of the herein described structural elements is a low cost easy to assemble structure that can be used for any desired purpose such as for a dwelling, storage, garage or the like, which is comparable in all respects to such structures when constructed from conventional materials.

The present invention, including novel structural elements, their method of formation and structures formed therefrom, has been disclosed in its preferred embodiments. The scope of the invention embraces equivalent structures and elements and is only limited by the appended claims in view of the prior art.

What is claimed is:

1. A method of forming a wall structure for a building from a series of structural elements formed from multi-layered corrugated fiberboard comprising the steps of:

providing a sheet of multi-layered corrugated fiberboard having at least two layers of corrugated flutes disposed between at least three substantially flat facing sheets;

cutting said sheet to form a blank of said multi-layered corrugated fiberboard;

forming grooves in said blank at predetermined locations to divide said blank into a plurality of panel portions including a substantially rectangularly shaped face panel portion, two substantially rectangularly shaped side panel portions disposed adjacent to elongated sides of said face panel portion and two substantially rectangularly shaped end panel portions;

aligning said grooves with said blank such that said corrugated flutes extend laterally in a substantially parallel direction to said elongated sides of said rectangularly shaped face panel portion and elongated sides of said two substantially rectangularly shaped side panel portions;

folding said blank along said grooves such that said side panel portions and said end panel portions are substantially normal to each other and said face panel portion to form a shallow rectangularly shaped box-like structural element;

attaching a plurality of said shallow rectangularly shaped box-like structural elements along said side panel portions to form said wall structure for said building such that said elongated sides of said rectangularly shaped face panel portions are adjacently disposed and said face panel portions extend the entire height of said wall structure with said corrugated flutes aligned with a substantially vertical orientation to provide sufficient compressive strength to support said building.

2. The method of claim 1 wherein said step of providing a sheet of multi-layered corrugated fiberboard comprises:

providing a sheet of multi-layered corrugated fiberboard having three layers of corrugated flutes disposed between four substantially flat facing sheets such that the entire cross-sectional thickness of said multi-layered corrugated fiberboard is approximately ⅝ths of an inch.

3. The method of claim 1 wherein said step of attaching a plurality of rectangularly shaped box-like structural elements comprises:

gluing and stapling said elements along said side panel portions.

4. The method of claim 3 further comprising the step of:

forming at least one opening in said wall structure for at least one door.

5. The method of claim 3 further comprising the step of:

forming at least one opening in said wall structure for at least one window.

6. The method of claim 3 further comprising the steps of:

forming a structural beam member from multi-layered corrugated fiberboard to support said structural building elements of said building structure.

7. A method of forming a building from a series of modular structural building elements formed from multi-layered corrugated fiberboard comprising the steps of:

providing a sheet of multi-layered corrugated fiberboard having at least two layers of corrugated flutes disposed between at least three substantially flat facing sheets:

placing cuts in said sheet to form a plurality of blanks of said multi-layered corrugated fiberboard;

forming grooves in said blanks at predetermined locations to divide said blanks into a plurality of panel portions including a substantially rectangularly shaped face panel portion, substantially rectangularly shaped side panel portions disposed along elongated sides of said substantially rectangularly shaped face panel portion, and substantially rectangularly shaped end panel portions such that said corrugated flutes extend laterally in a direction substantially parallel to said elongated sides of said rectangularly shaped face panel portion;

folding said blanks along said grooves such that said side panel portions and said end panel portions are substantially normal to each other and said face panel portion to form shallow rectangularly shaped box-like modular building elements;

attaching said shallow rectangularly shaped box-like modular structural building elements along adjacent side panel portions to form a substantially flat multiple panel building structure such that said face panel portions and said corrugated flutes extend entirely across said substantially flat multiple panel structure in a predetermined direction to increase compressive strength of said substantially flat multiple panel structure in said predetermined direction;

attaching a plurality of said substantially flat multiple panel structures to form a wall structure such that said predetermined direction is substantially vertically disposed to increase compressive loading of said wall structure in a substantially vertical direction;

attaching at least one of said substantially flat multiple panel structures to said wall structure to form a roof structure.

8. The method of claim 7 wherein said step of providing a sheet of multi-layered corrugated fiberboard comprises:

providing a sheet of multi-layered corrugated fiberboard having two layers of corrugated flutes disposed between three substantially flat facing sheets such that the entire cross-sectional thickness of said multi-layered corrugated fiberboard is approximately ⅛ths of an inch.

9. The method of claim 7 wherein said step of attaching a plurality of rectangularly shaped box-like structural elements comprises:

gluing and stapling said elements along said side panel portions.

* * * * *